US007421861B2

(12) United States Patent
Danner et al.

(10) Patent No.: US 7,421,861 B2
(45) Date of Patent: Sep. 9, 2008

(54) TAKE-OFF COMB FOR A KNITTING OR LOOP-FORMING MACHINE

(75) Inventors: Stefan Danner, Bitz (DE); Günther Büchle, Bad-Waldsee (DE); Eckhard Fehrenbacher, Bondorf (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 11/700,760

(22) Filed: Feb. 1, 2007

(65) Prior Publication Data

US 2007/0180864 A1 Aug. 9, 2007

(30) Foreign Application Priority Data

Feb. 3, 2006 (DE) ..... 10 2006 005 384

(51) Int. Cl.
*D04B 27/34* (2006.01)

(52) U.S. Cl. ..... 66/149 R

(58) Field of Classification Search ..... 66/149 R, 66/152, 147

See application file for complete search history.

(56) References Cited

U.S. PATENT DOCUMENTS

| | | | | |
|---|---|---|---|---|
| 3,376,716 | A * | 4/1968 | Joseph | 66/150 |
| 3,913,358 | A | 10/1975 | Dhondt | |
| 4,488,416 | A * | 12/1984 | Shima et al. | 66/149 R |
| 5,040,384 | A | 8/1991 | Shima | |
| 5,241,841 | A * | 9/1993 | Schmid et al. | 66/149 R |
| 5,899,094 | A * | 5/1999 | Ikoma | 66/149 R |
| 6,155,082 | A * | 12/2000 | Schimko et al. | 66/149 R |

FOREIGN PATENT DOCUMENTS

| | | | |
|---|---|---|---|
| CH | 69 470 | A | 7/1915 |
| CH | 457 693 | A | 6/1968 |
| DE | 5 903 | C | 7/1879 |
| DE | 261 699 | C | 6/1913 |
| DE | 850 500 | | 9/1952 |
| DE | 1 950 293 | U | 11/1966 |
| DE | 1 585 008 | | 2/1972 |
| DE | 24 20 553 | | 1/1975 |
| DE | 74 37 338 | | 3/1975 |
| DE | 40 03 667 | A1 | 8/1990 |
| DE | 281 832 | A5 | 8/1990 |
| EP | 0 979 892 | A2 | 2/2000 |
| FR | 1 435 256 | A | 4/1966 |
| GB | 630 151 | | 10/1949 |

OTHER PUBLICATIONS

European Communication dated Sep. 11, 2007 with International Search Report(EPO Form 1503 03.82 (P04C03).

Von O. Rieder and Dr.-Ing. G. Bühler, G.:Die Problematik des Warenabzugs an Flachstrickmaschinen. In: Wirkerei- und Strickereitechnik. 1988, Jg. 38, Heft 8, S. 813-820.

* cited by examiner

*Primary Examiner*—Danny Worrell
(74) *Attorney, Agent, or Firm*—Norman N. Kunitz; Fitch, Even, Tabin & Flannery

(57) ABSTRACT

A take-off comb, in particular for a flat-bed knitting machine or a loop-forming machine, comprising a number of take-off elements that are held in a bed (19), with the bed consisting exclusively of bent sheet metal parts. The take-off elements (10) may comprise closing elements (15) that can be shifted by a closer ledge (35). The closer ledge (35) and, optionally, a slider (45) assigned to the ledge, are preferably also bent sheet metal parts. Consequently, the thusly configured take-off comb (7) can be manufactured in a cost-effective and precise manner.

21 Claims, 6 Drawing Sheets

TAKE-OFF COMB FOR A KNITTING OR LOOP-FORMING MACHINE

CROSS REFERENCE TO RELATED APPLICATION

This application claims the priority of German Patent Application No. 10 2006 005.384.2, filed on Feb. 3, 2006, the subject matter of which, in its entirety, is incorporated herein by reference.

BACKGROUND OF THE INVENTION

The invention relates to a take-off comb for a knitting or looping machine.

In a knitting or loop-forming machine, the stitches have to be taken off the needles after the loop-forming operation. To do so, a take-off comb is frequently used at the start of the knit fabric. This comb is also used to catch a first row of stitches and to take this first row of stitches off the knitting sites in a controlled manner.

Such a take-off comb has been known from document DE 40 03 667 A1, for example. There, the comb is located below the comb gap formed between two needle beds and can sink into said beds. As its base body, this take-off comb comprises a longitudinal profiled body which represents a take-off needle support. It is provided with a row of needle grooves which are arranged parallel to each other and in which take-off needles are seated. Each take-off needle has a needle body in which a slider is supported in a sliding manner. A transverse ledge holds the ends of the sliders in order to move them in a manner synchronous with respect to each other in longitudinal direction of the needles and, in so doing, opens or closes the hook of the needle. The transverse ledge is adjusted by a cam plate having a rocker which translates a longitudinal motion of the cam plate into a transverse motion that is transmitted to the transverse ledge.

The manufacture of such a take-off comb is relatively expensive. This is justified by the precise specifications required for such a take-off comb, in view of its support and positioning of the closing elements.

Considering this, it is the object of the invention to provide a simplified take-off comb for a knitting or loop-forming machine.

SUMMARY OF THE INVENTION

The above object generally is attained with the inventive take-off comb which comprises a support device for the support of the take-off elements. Preferably, the support device accommodates the shaft at points that are at a distance from each other in longitudinal direction of said shaft, for example, between respectively two teeth of two tooth pairs at a distance from each other in longitudinal direction of the shaft, and clamps the shaft of the holding element between preferably flat clamping surfaces (e.g., the flat sides of a metal positioning plate and a metal alignment plate). The support device consists mainly of a bent sheet metal part. The bent sheet metal part represents a girder which is optionally provided with a metal support plate. In addition, the take-off comb comprises a closer ledge which is designed as a bent sheet metal part. The girder that is used to act as a support for the take-off elements consists of sheet metal, for example, of sheet steel. Referring to a first embodiment, said support has angled sections between which the take-off elements are held. Referring to a second embodiment, said support supports a metal support plate which is provided with angled sections for the alignment of the take-off elements.

The angled sections form at least two rows that are parallel to each other. Consequently, the take-off elements are no longer seated in the needle grooves as was the case in prior art, but they are only held at points of their shaft that are at short distances from each other in longitudinal direction. The length of these support locations corresponds to the thickness of the metal sheet of which the support (or, if present, the metal support plate) is made.

Those skilled in the art have available to them a large spectrum of manufacturing processes for the manufacture of bent metal parts, taking into consideration accuracy requirements and the number of items to be produced. These include punching processes, bending processes and punch-bending processes, such as, for example, laser cutting and bending processes.

The girder and/or the metal support plate have angled sections which, for example, are formed by an angled edge having cutouts. The stationary parts of the edge form fingers between which interstices remain for the accommodation of the take-off elements.

It is also possible to use, for example, U-shaped sections of the girder or of the metal support plate to fashion or bend outward such fingers or tongues. Also, in this case, interstices may be formed between adjacent fingers, said interstices acting to accommodate the take-off elements. In so doing, the take-off elements are preferably accommodated lying flat. For example, they have a rectangular cross-section limited by two larger and by two narrower flat sides, in which case the larger flat sides are preferably arranged horizontally in a common plane. This offers the advantage that the take-off comb can be used even when the needle gaps are very narrow.

In order to align the take-off elements relative to each other, a metal alignment plate may be provided, which, for example, is designed as a metal strip located between two rows of angled sections of the metal support plate and/or the support and preferably has a flat upper side. Depending on the embodiment of the take-off comb, the narrow sides or the larger flat sides of the take-off elements rest on said upper side.

The girder, together with the metal support plate, or the metal support plate itself, preferably comprises two parallel rows of angled sections which cooperate with spaced-apart sections of the take-off element. Each take-off element is then held between four angled sections which, together in pairs, define two interstices.

Said angled sections can be formed directly on the support or on a separate metal support plate. It is also possible to form one row of angled sections on the girder and another row on the metal support plate. It is only important that the take-off elements be assigned at least two rows of comb-like arranged angled sections, between which said take-off elements are supported. In other words, the take-off elements are supported in parallel rows of slots and interstices, each being supported at points at a distance from each other.

Preferably, however optionally, it is also possible to provide a metal positioning plate that also has at least one row of angled sections between which interstices are provided for the accommodation of the take-off elements. This metal positioning plate may lie flat on the take-off elements, and may be tensioned with respect to said elements in order to hold said elements in place. The tensioning direction may be fixed in the direction of the angled sections. Alternatively or additionally, the metal positioning plate can be tensioned in its longitudinal direction, i.e., transverse to the angled sections with respect to the take-off elements, in order to eliminate the play between the take-off elements and the angled sections. In this manner, good alignment of the take-off elements can be achieved by simple means. The angled sections of the metal positioning plate can also act to hold the take-off elements on their feet in longitudinal direction, with or without minimal play. Alternatively, angled sections may be provided for this purpose on the metal support plate or on the girder.

Preferably, the take-off elements are made of two parts such that they each comprise one base body and at least one movably supported closing element. While the base bodies of the take-off elements are preferably stationarily supported on the girder or on the metal support plate, the closing elements are connected to a movably supported closer ledge that preferably has angled sections between which the ends of the closing elements are held. In addition, the closer ledge is assigned a locating ledge that is designed as a bent metal part. Together, this locating ledge and the closer ledge define a groove in which the feet of the closing elements are supported. The movement of the closer ledge on the girder can be effected by a slider, which, for example, is also designed as a bent sheet metal part and has an angled edge that comes into engagement with a groove formed between the closer ledge and the locating ledge. Said slider can be moved longitudinally in said groove but transmits transverse movements. A rocker guide can translate a longitudinal movement of the slider into a transverse movement of said slider, said movement being transmitted to the closing elements via the closer ledge.

By using the idea presented here, the take-off comb can be manufactured—with the exception of the take-off elements and their closing elements, as well as, optionally, with the exception of a few screws, rivets, bearings and miscellaneous small parts—of sheet metal parts and of bent sheet metal parts. The bent sheet metal parts are preferably free of weld seams. However, in order to attach other parts, including bent sheet metal parts, or to attach bent sheet metal parts to each other, it is also possible to use weld spots or weld seams.

Referring to another embodiment, the sheet metal parts and the bent sheet metal parts are made of plastic material. These plastic material parts are then joined to each other preferably by material-to-material connections, for example, by means of spot cementation.

The described idea can also be used in those cases in which the closing element is designed to have such a form that it grasps the stitches to be held, without forming a closed space on the take-off element, whereby the stitch is held in said space. In this case, the slider has a hook-like stitch-catching section that grasps the stitches.

The take-off elements may be arranged lying flat in one plane, whereby the elements' narrow sides face each other. If an appropriately narrow configuration of the interstices between the angled sections of the metal support plate, the support and/or the metal positioning plate is used, the take-off elements can be arranged next to each other in such a manner that they face each other with their wide sides, i.e., their larger flat sides. Either idea can be used to obtain a cost-effective, yet precisely manufacturable, take-off comb.

Additional advantageous details and modifications of embodiments in accordance with the invention are obvious from the drawings, the corresponding description and/or the claims.

Exemplary embodiments in accordance with the invention are shown by the drawings.

Figure 1:
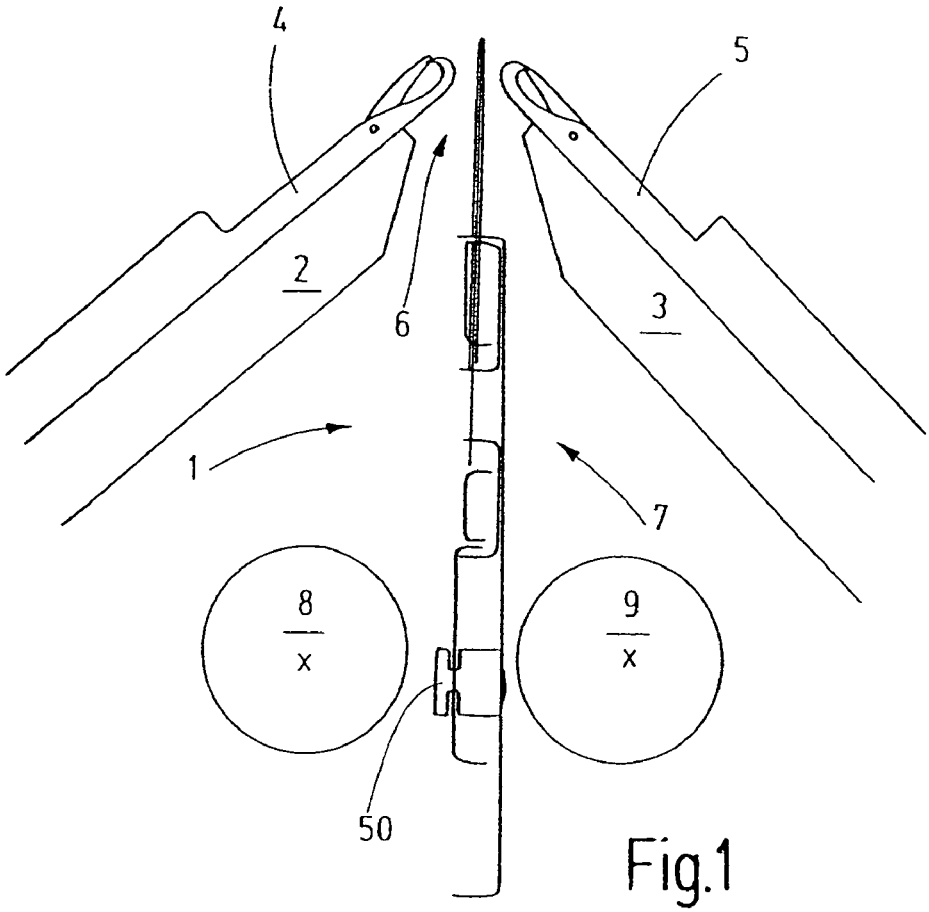
FIG. 1 is a schematic side view of two needle beds with a take-off device designed as a take-off comb, and two take-off rollers.

FIG . 9 is a schematic front view of a modified embodiment of a take-off comb in accordance with FIG. 1.

DETAILED DESCRIPTION OF THE INVENTION

In FIG. 1, a take-off device 1 is illustrated with reference to a knitting machine, which is designed as a flat-bed knitting machine, and with reference to two needle beds 2, 3. Each of the needle beds 2, 3 has needle channels that are parallel to each other with the needles 4, 5 supported in them, said needles being designed as latch-type needles or as compound needles and being used for producing a knit fabric. Locks for driving the needles 4, 5 are provided; however, these locks are not illustrated in detail. A comb gap 6 is formed between the needle beds 2, 3 and the needles 4, 5, into which gap a take-off comb 7, assigned to the take-off device 1, can penetrate from the bottom. In addition, the take-off device 1 can comprise additional take-off means, for example, in the form of two take-off rollers 8, 9, which are arranged under the needle beds 2, 3 and which can come into engagement with the knit fabric when the knit fabric has been moved far enough downward by the take-off comb 7.

Figure 2:
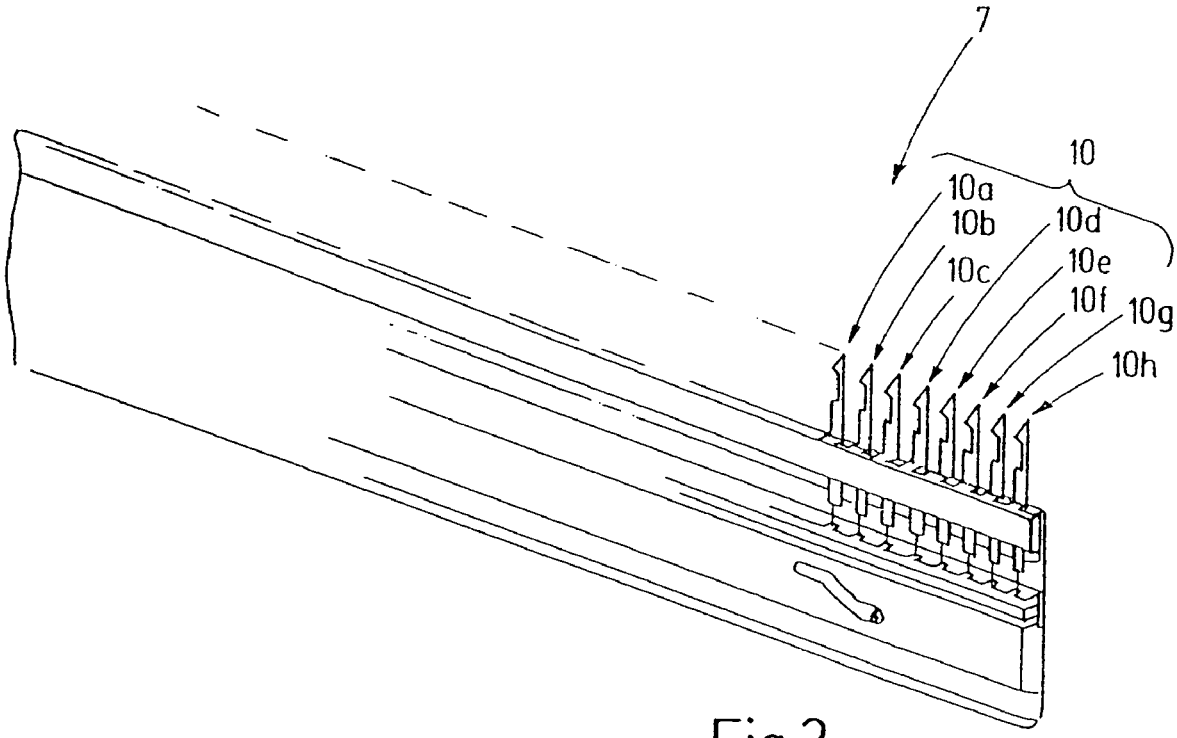
FIG. 2 is a schematic perspective view of the take-off comb in accordance with FIG. 1.
Figure 4:
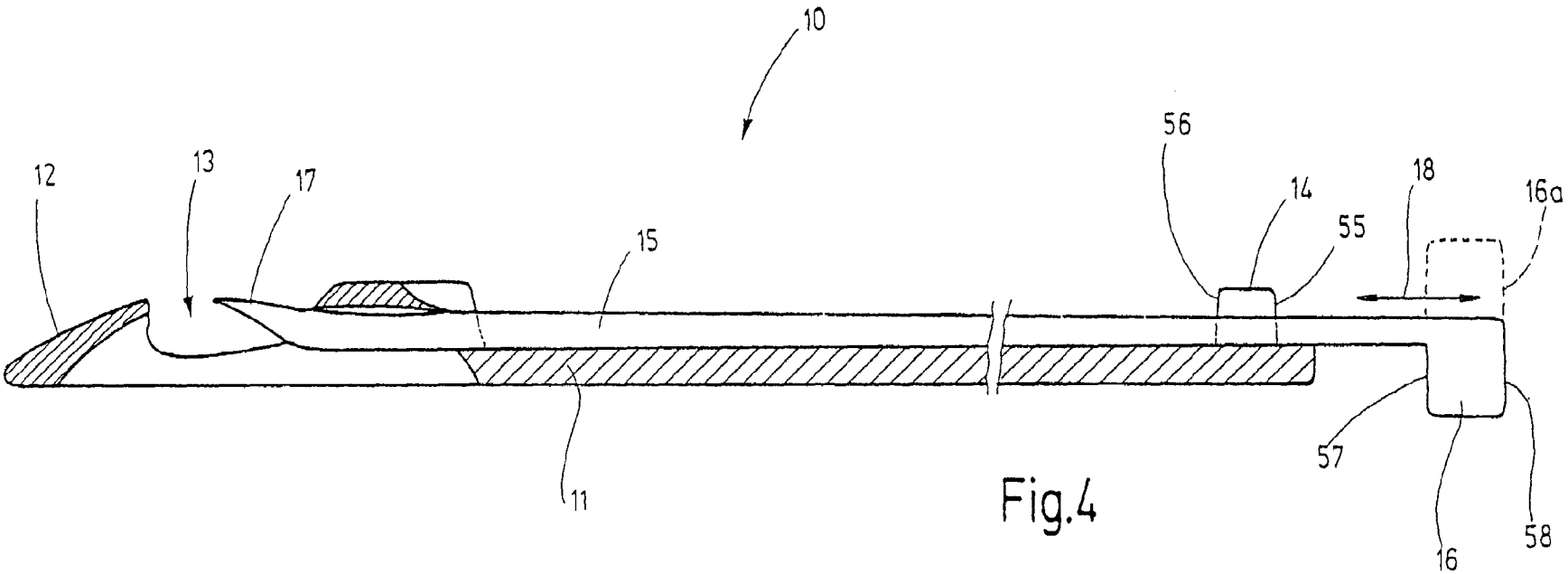
FIG. 4 is a schematic illustration, in vertical section, of a take-off element and of a closing element accommodated therein.

FIG. 2 shows the take-off comb 7 by itself. This take-off comb has a row of adjacent take-off elements 10, which, in order to distinguish them from those in FIG. 2, are provided with a letter index. The take-off elements 10 have the same configuration relative to each other. FIG. 4 shows the take-off element 10 as being representative of all others. The take-off element 10 comprises a base body 11 with a shaft that has, on its one end 12, a thread-take-up space 13 and, on its other end, a foot 14 in order to support the take-off element 10 in a stationary manner. Machined into the base body 11 is a channel through which extends a closing element 15. This element is designed like a slider and is provided, on its one end, with a closing projection 17. The foot 17 is used for a specific longitudinal sliding movement, while the closing projection 17 is used for opening and closing the thread-take-up space 13. It is pointed out that the form and design of the end 12, the thread-take-up space 13, the closing projection 17, as well as additional details of the take-up element 10, can be modified within wide limits. It is essential that the thread-take-up space 13 be opened and closed by a movement of the slider element 15 relative to the base body 11 of the take-off element 10. Referring to the embodiment of FIG. 4, this relative motion takes place by means of the foot 16 of the slider element 15 with respect to the foot 14 of the take-off element 10 in the direction of the indicated arrow 18. Other embodiments, which generate a relative motion in another manner, are also possible. For example, it is possible to move the base body 11 relative to the slider 45.

Figure 3:
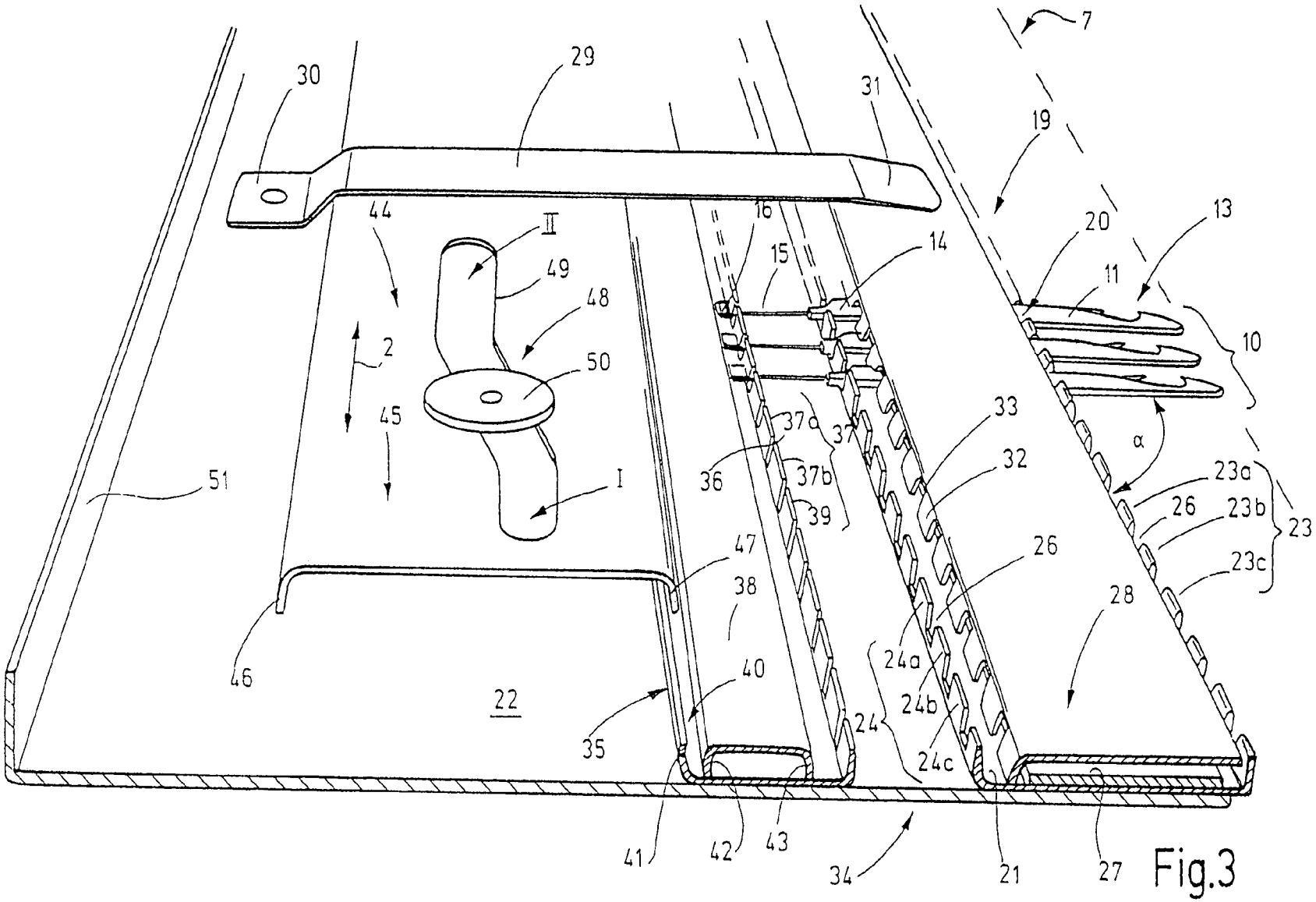
FIG. 3 is a modified perspective view of the take-off comb in accordance with FIG. 2.

FIG. 3 shows the take-off comb 7. A bed 19 for the accommodation of the take-off elements 10 is provided on said comb. In the present embodiment, the take-off elements 10 are arranged horizontally, i.e., the narrow sides of the take-off elements 10 face each other. In addition, each thread-take-up space 13 opens up to its respectively adjacent take-off element.

Corresponding sections of the shafts of the take-off elements 10 are lying in the bed 19, and thus form the holding sections 20 of the take-off elements 10. Assigned to the bed 19 is a metal support plate 21, which is designed as a bent sheet metal part. This part may have the same form, and may be alternatively designed as a flat plastic material part having angled sections. This part can be mounted to a girder 22, which is also designed as a bent sheet metal part. The metal support plate 21 preferably has a flat rear section having two parallel long narrow edges from which project the angled sections 23, 24. Between each of the angled sections 23, 24 are interstices 25, 26, which may be provided before, as well as after, bending the sections 23, 24 at an angle. The angled sections 23, 24 form two straight parallel rows that extend upward, approximately at a right angle, from the plane central section of the metal support plate 21. The metal support plate 21 thus forms a flat U-shape. The widths of the interstices 25, 26 are dimensioned such that the take-off elements 10 are held in them with minimal play. To achieve this, the take-off elements 10 have sections (foot 14) that have a greater width than the width of the interstices 25, 26. As a result of this, edges 55 are formed on the take-off elements 10, said edges coming into abutment with the metal support plate 21 following the insertion of the take-off elements 10 in the interstices 25, 26. Thus, the sections 24 form abutment surfaces for the take-off elements 10. As a result of this, the take-off elements 10 are supported by the girder 22 via the metal support plate 21.

In the metal support plate 21, a metal alignment plate 27 may be provided, which alignment plate can be attached by screws, rivets, weld spots, weld seams, cement spots or other joining means. The metal alignment plate 27 preferably has a flat upper side that supports the take-up elements 10. The interstices 25, 26 extend under a plane that is defined by the upper side, i.e., the support surface of the metal alignment plate 27. The alignment of the take-off elements 10 parallel to the large flat side of the girder 22 is thus determined by the metal alignment plate 27. The take-off elements 10 preferably are held at an angle $\alpha$ of 70° to 110°, preferably 90°, with respect to the narrow side of the metal alignment plate 27. This alignment of the take-off elements 10 is determined by the teeth of the metal support plate 21, said teeth being formed by the sections 23, 24.

A metal positioning plate 28 can be used to tension the take-off elements 10 with respect to the metal alignment plate 27. The metal positioning plate 28 is designed as a flat strip of sheet metal, which should be tensioned with the use of appropriate fastening means with respect to the metal alignment plate 27. In a similar form, the metal positioning plate 28 can alternatively be designed as a flat plastic material part, with or without angled sections. An example of a fastening means is a row of clamping fingers 29 in the form of narrow sheet metal strips, which are fastened by one end 30 to the support 22. A screw, rivet, weld joint or the like, may be used for fastening. The other end 31 of the clamping finger 29 pushes the metal positioning plate 28 against the flat sides of the take-off elements 10 and, thus, the take-off elements 10 against the metal alignment plate 27.

The metal positioning plate 28 may be provided on one or both sides with a row of angled sections 32, between which interstices 33 are formed. The width of these interstices 33 is smaller than the foot width 14 of the take-off elements 10. The sections 32 form fingers which can engage between the take-off elements 10. As a result of this measure, the feet 14 of the take-off elements 10 can be secured in place, so that the base bodies 11 of the take-off elements 10 are supported such that they cannot be moved in their longitudinal direction. The take-off elements 10 are in abutment with the metal support plate 21 in one direction—via the edges 55 (FIG. 4)—and in the other direction with the metal positioning plate 28—via the edges 56. The foot 14 of a take-off element 10, having a width that is greater than the width of the interstice 25, 26 of the metal support plate 21 and the interstice 33 of the metal positioning plate 28, is tensioned between the metal support plate 21 and the metal positioning plate 28. Furthermore, it is possible to use the metal positioning plate 28 to exert pressure not only in the direction toward the metal alignment plate 27 but also in longitudinal direction thereof. Consequently, the base bodies 11 of the take-off elements 10 are respectively pushed against one flank of each interstice 25, 26, thus supporting them without play. To achieve this, the metal positioning plate 28 can be connected with appropriate tensioning means, springs, cams, clamping claws or the like. With the use of these, the metal positioning plate 28 is pushed in the desired direction.

The metal positioning plate 28 described so far, the metal support plate 21 and the girder 22, to this extent, form a support device 34 for the take-off elements 10, said support device consisting exclusively of bent sheet metal parts.

For opening and closing the take-off elements 10, i.e., for moving the closing elements 15, a closer ledge 35 may be provided, whereby said ledge may also be made of a bent sheet metal part. Having the same form, said part may alternatively be designed as a flat plastic material part with angled sections. The closer ledge, in turn, may be a flat U-shaped body having two angled edges. Again, the edge facing the take-off elements 10 is provided with slits that form the interstices 36 between the angled sections 37. The ends of the closing elements 15 extend through the interstices 36, in which case the edges 57 (FIG. 4) of the feet 16, said feet having a width exceeding the width of the interstices 36, abut against the inside of the closer ledge 35. Consequently, the feet 16 form holding sections of the closing elements 15. In order to secure the feet 16 on the closer ledge 35, a locating ledge 38 may be arranged on their inside space. The locating ledge 38 may have a solid profile or, as illustrated, it may again have a flat U-shape made of a bent sheet metal part. Having the same form, it may alternatively be configured as a flat plastic material part having angled sections. Preferably, the use of a metal strip is assumed, whereby both edges of said strip are bent at an angle. The locating ledge 38 can be joined to the closer ledge 35 by appropriate means such as, for example, rivets, screws or even weld spots. Together with the slotted edge of the closer ledge 35, said locating ledge defines a first groove 39 for the accommodation of the feet 16, and defines a guide groove 40 with the opposite edge, said guide groove 40 being limited on one side by an edge 41 of the closer ledge 35 and on the other side by an edge 42 of the locating ledge 38. The opposing edge 43 of the locating ledge 38 acts as abutment for the end faces 58 (FIG. 4) of the closing elements 15. The closing elements 15 are held by frictional connection between the section 37 of the closer ledge and the edge 43 of the locating ledge 38.

The closer ledge 35 can be moved on the girder 22 toward the metal support plate 21 and away therefrom in a direction transverse to its longitudinal direction. Consequently, said closer ledge can shift the closing elements 15 relative to the base bodies 11 of the take-off elements 10, and can thus open or close the thread-take-up spaces 13.

To achieve a specific shifting movement of the closer ledge 35, an actuation device 44 may be provided, said device comprising, for example, a slider 45 made of a bent sheet metal part. Having the same form, this part may alternatively be configured as a flat plastic material part having an angled section. The slider 45 comprises two edges 46, 47 that are preferably angled in the same direction and may have different heights. While the edge 46 may be supported on the girder 22, the edge 47 extends into the guide groove 40, in which it is accommodated with minimal play. The slider 44 is supported on the girder 22 so that it can be moved along the guide groove 40. When said slider is moved, the closing ledge 35 does not participate in the longitudinal movement along the groove 40 The groove 40 and the edge 47 of the slider 45 thus form a clutch for disengaging the closer ledge 35 and the slider 45 with respect to longitudinal movements. However, transverse movements, which occur in a direction along the closing elements 15, will be transmitted directly.

The slider 45 may be provided with a rocker guide 48, which is associated with a longitudinal opening 49. The opening 49 has a section that extends at an angle with respect to the longitudinal direction L of the slider 45. The longitudinal direction L coincides with the longitudinal direction of the slider ledge 35. A bolt 50 extends through the opening 49, whereby, as is obvious from FIG. 1, said bolt is preferably provided with an annular groove through which extends the edge of the opening 49. Thus, several such rocker guides 48 that are distributed over the longitudinal extension of the slider 45 hold the slider 45 on the girder 22 and, at the same time, effect a transverse adjustment if said girder is moved in longitudinal direction. Not specifically illustrated actuation devices, such as manual actuation devices, electrical, mechanical, pneumatic or hydraulic actuators, can be used for longitudinal adjustment.

It is also possible to fabricate the bolt 50 in multiple parts (not illustrated). The annular groove is then formed in that two bushings are arranged at a distance from each other on a rotary axis. The distance between the two bushings then forms the height of the annular groove. The two bushings may have different diameters. For example, the bushing below the slider 45 may have a large diameter and thus offer the slider a flat support surface.

The operation of the take-off device described so far is as follows:

If a thread is taken up by the needles 4, 5 in accordance with FIG. 1, the thread sections extend between the hooks of these needles 4, 5. Now the take-off comb 7 is moved from underneath into the comb gap 6. The take-off elements 10 are open. To achieve this, the slider 45 is moved into a position in which the section I of its opening 49 abuts against the bolt 50. This section I is the section of the opening 49 that is close to the closer ledge 35. As a result of this, the closer ledge 35 is moved maximally away from the bed 19, and the closing elements 15 clear the thread-take-up spaces 13. In this state, the take-off elements 10 now grasp the thread sections, whereupon they are closed. This is achieved by moving the slider 45 in closed position, whereby the section 11 of the slider's opening 49 reaches the bolt 50. The section 11 is that part of the opening 49 that is remote from the closer ledge 35. As a result of this, the closer ledge 35 is moved toward the bed 19, thus causing the closing elements 15 to close. The knitting process can now be continued. In so doing, the take-off comb 7, with the use of suitable force-generating means or even by its own weight, pulls down the knit fabric—that is in the process of being created—and, in so doing, pulls the knit fabric off the needles 4, 5.

Figure 5:
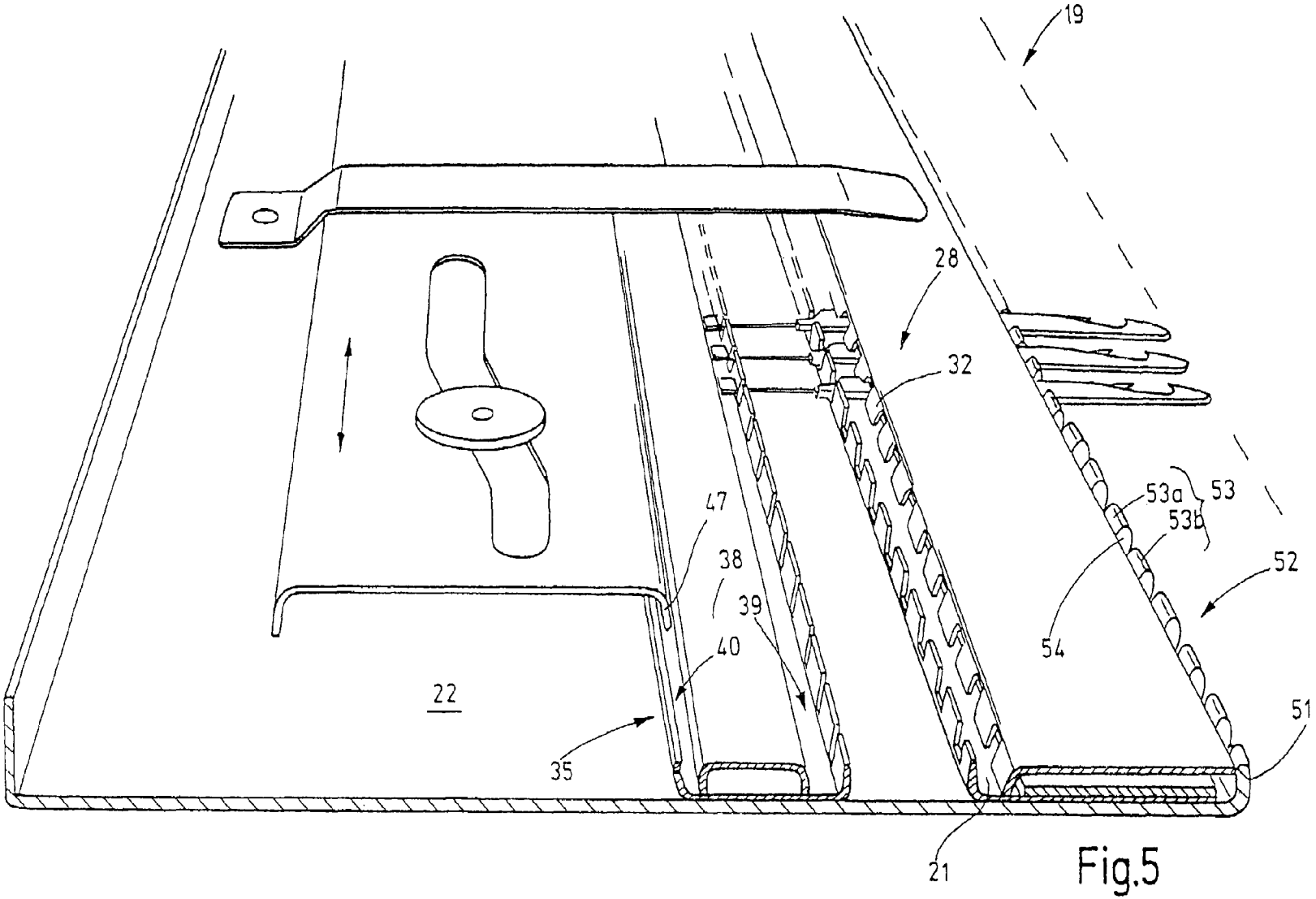
FIG. 5 is a modified embodiment of a take-off comb consisting of bent sheet metal parts.

FIG. 5 depicts a modified embodiment of the take-off comb 7 in accordance with the invention. Unless explained otherwise hereinafter, the above description applies.

In this case, the bed 19 is formed by the metal support plate 21 and by the girder 22. As already described above, the latter has a stiffening edge 51 extending from the bed 19 and has, on its opposite side, an angled, multiply interrupted edge 52 with multiple slits. In this manner, the angled sections 53 (53*a*, 53*b*) are formed, and the interstices 54 are defined between them. These interstices have the same dimensions as the interstices 25 of the above-described exemplary embodiment.

Another possible modification dispenses with the metal support plate 21 and, instead, has free-standing tongues that are bent upward from the central section of the girder 22. Again, interstices remain between the tongues, said interstices having dimensions substantially corresponding to those of the interstices 26. Consequently, the tongues replace the sections 24.

Figure 7:
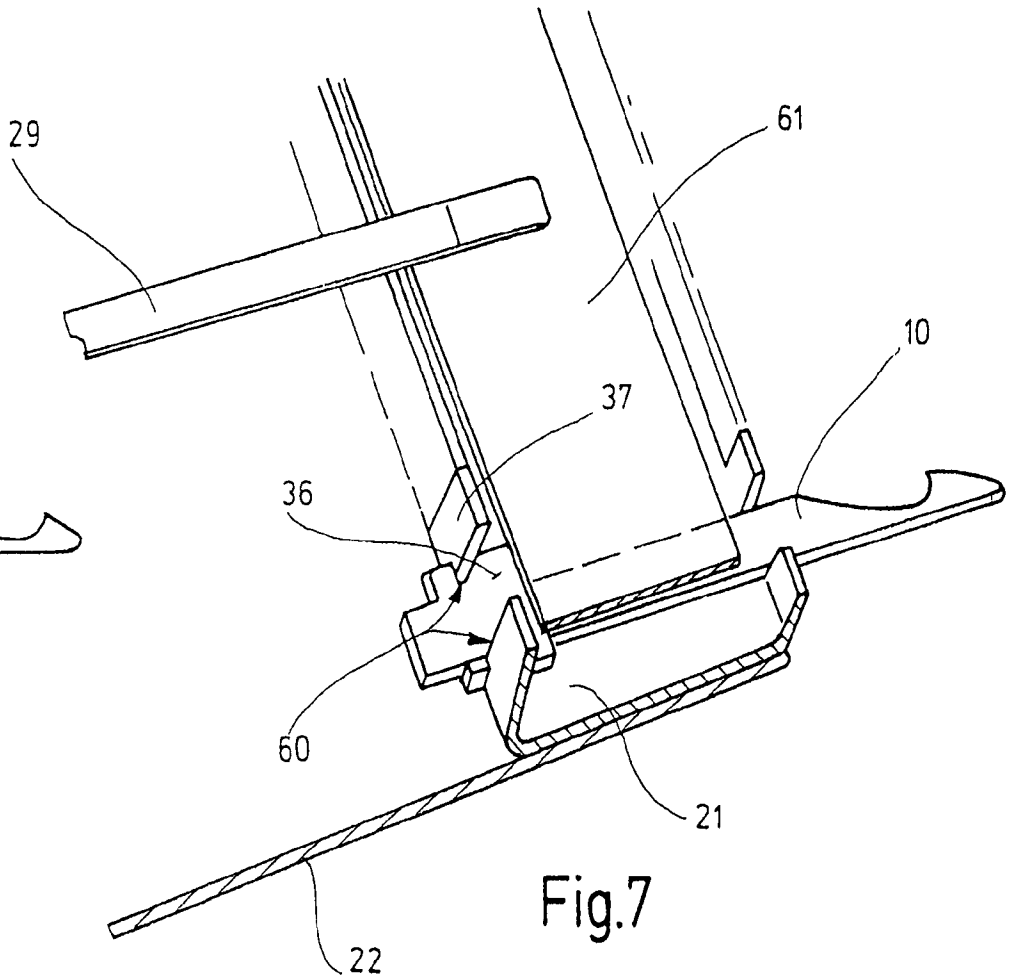
FIG. 7 is a detail of a schematic perspective illustration of a modified embodiment of a take-off comb in accordance with FIG. 1.

Referring to another embodiment (FIGS. 7 and 8), the take-off element 10 has a holding section or a coupling location 60 in the form of a recess that may also be regarded as a "negative foot 14". Instead of projections, which form the edges 55 and 56 (FIG. 4) that project from the base body 11, the coupling location 60 of a take-off element 10 in accordance with FIG. 8 can have the edges 55' and 56' which limit a recess extending into the base body 11. Consequently, the coupling location 60 can comprise a recess in the base body 11. In accordance with FIG. 8, the base body 11 may adjoin one of the narrow sides of the take-off element 10 and is open toward the outside. It is also possible to provide this coupling location 60 on both narrow sides of the take-off element 10 (FIG. 7). The coupling location 60 may have the configuration of a rectangle; however, it may also have another shape, which ensures coupling with the metal support plate 21 in a form-closed manner. The form closure may be designed with minimal play. If the take-off element 10 has coupling locations 60 having openings facing away from each other and having the same distance—measured in longitudinal direction of the take-off element 10—from a common point of said take-off element, the depth of the coupling locations 60 may be less than 50% of the width of the take-off element 10. If the distances are different, the depth of a single coupling location 60 may be greater than half the width of the take-off element 10.

Likewise, the closing element 15 may have a holding section in the form of a coupling location 60 (not illustrated) instead of a foot 16. Regarding this coupling location 60, the description above applies accordingly. Such a closing element 15 can then be coupled with the closer ledge 35 via a coupling location 60. The recess of the coupling location 60 can then partially extend around the section 37 in a similar manner as has been shown in FIG. 7 with respect to the take-off element 10 and the metal support plate 21. The locating ledge 38 may then be superfluous because the section 37 extends through the coupling location with minimal play. This results in a form closure. In this case, the groove 39, in accordance with FIGS. 3 and 5, is not necessary.

Figure 6:
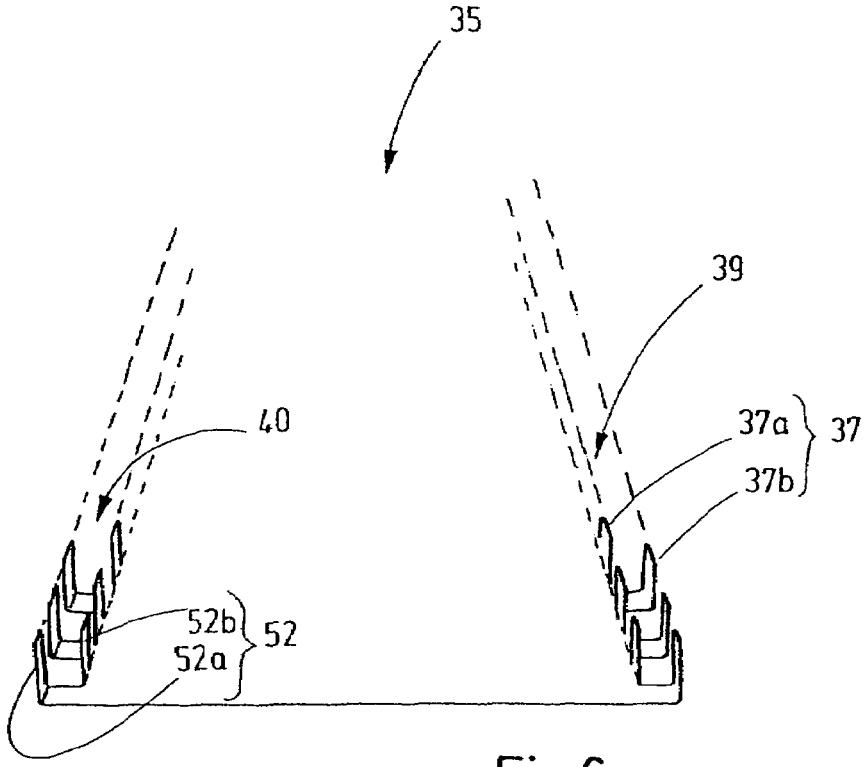
FIG. 6 is a modified embodiment of a closer ledge.
Figure 9:
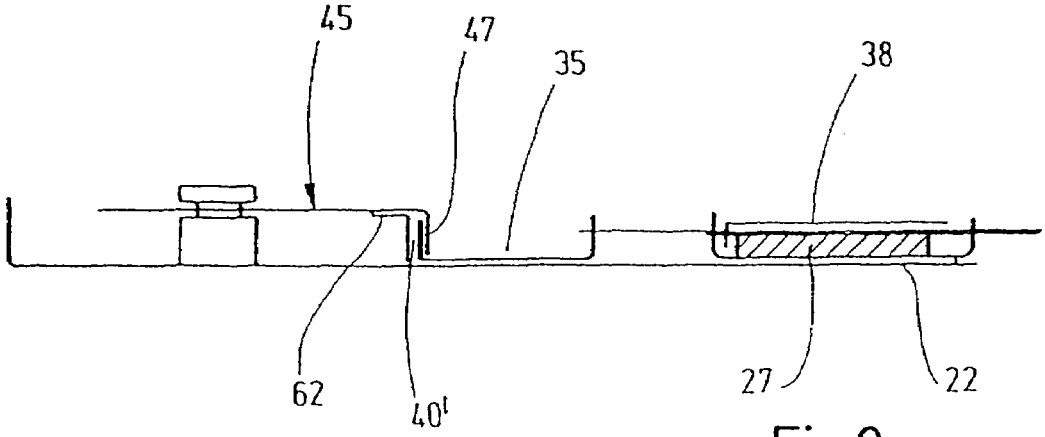

Likewise, the groove 40 may be omitted. FIG. 9 shows a corresponding example. The edge 47 of the slider 45 should be coupled with the slider ledge 35 in such a manner that the movement transverse to the longitudinal direction of the slider ledge 35 is possible, as described above. To do so, the slider 45 may have a groove 40', which comes into engagement with the edge 41 of the slider ledge 35. The groove 40' of the slider 45 can then be limited by an L-shaped bent sheet metal part, which is mounted to the slider 45 at a distance from the edge 47. Alternatively, the edge 47 can be configured as shown in FIG. 6.

Figure 8:
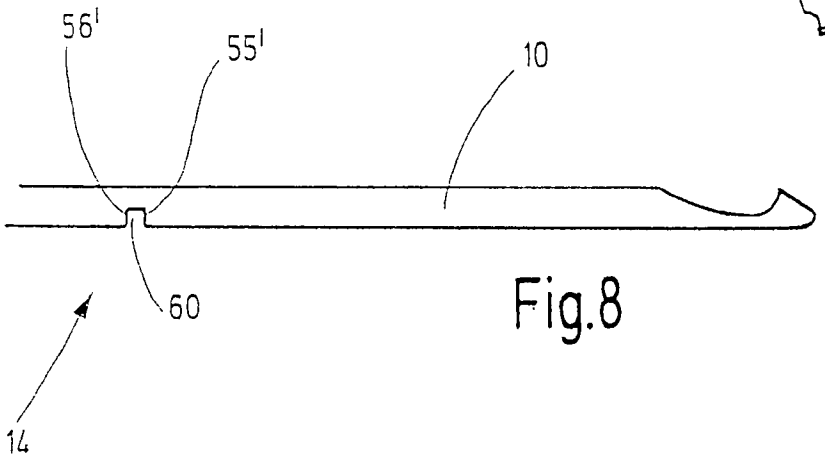
FIG. 8 is a detail of a schematic perspective illustration of a take-off element for use in a take-off comb in accordance with FIG. 7.

The design of the take-off element 10 in accordance with FIG. 8, specifically its coupling location 60, and the design of the closer 15 having a coupling location 60, make the metal positioning plate 28, the metal alignment plate 27, as well as the metal positioning plate 38, unnecessary. Consequently, only a metal positioning plate 61 is necessary for mounting the take-off elements 10. The metal positioning plate 61 may be designed as a metal ledge and be mounted with the use of the above-described means 29. Having the same form, said plate may alternatively be designed as a flat plastic material part with angled sections.

The embodiment of a take-off comb 1 in accordance with FIG. 7 is very cost-effective because, as described above, said embodiment consists of bent sheet metal parts, in which case the metal alignment plate 27, the metal positioning plate 28, as well as the locating ledge 38, may be omitted.

In conjunction with this, "bent sheet metal parts" are mainly understood to be parts of sheet metal, preferably sheet steel. However, as mentioned, it is also possible to use correspondingly formed parts of plastic material, which are then also understood to represent bent sheet metal parts. In so doing, it becomes possible to manufacture the take-off comb 1, or its individual parts, completely or partially of plastic material. To do so, glass-fiber reinforced plastic material is preferably used. The embodiment using bent sheet metal parts made of metal is preferred.

At this point, reference is made to the fact that a take-off comb 1 in accordance with FIG. 7 achieves the same effect as a take-off comb 1 in accordance with the above-described Figures. Consequently, to the extent that they are applicable, the same reference numbers are used.

All the aforementioned parts referred to as "bent sheet metal parts", which may also be made of plastic material, preferably comprise a substantially flat central section, in which case at least one edge is angled, or other angled sections, e.g., cut-out angled tongues, are provided. Each bent sheet metal part my be provided with reinforcement beads or similar structures, thus increasing its stiffness in longitudinal direction. The bending lines on the bent sheet metal parts, e.g., between the flat central sections and the angled edges or the angled sections, are preferably oriented parallel with respect to each other. The bent sheet metal parts may be manufactured by means of any suitable sheet metal machining process. Furthermore, it is possible to replace individual bent sheet metal parts with several bent sheet metal parts. For example, instead of the locating ledge 38, a pair of locating ledges may be provided, whereby one of the ledges is used to form the groove 40 and the other is used to form the groove 39. In addition, it is possible to use the locating ledge 38 strictly for the formation of the groove 39, and to form the guide groove 40 by providing the slider ledge 35 with staggered angled sections. For example, the even-numbered sections or teeth on a first bending line and the not even-numbered teeth on a second bending line that is arranged at a distance but parallel to the first bending line are angled. Between the two rows of angled teeth a channel is formed, into which the edge 47 may engage. Likewise, the teeth or by sections 32 of the metal positioning plate 28 may be replaced by free-standing tongues or teeth or sections of the metal positioning plate 21 or by corresponding sections of the metal alignment plate 27.

FIG. 6 shows a closer ledge 35, which does not require a locating ledge. As described above, this closer ledge 35 has an edge of angled sections 37 (37*a*, 37*b*) that are configured as prongs or teeth. However, the sections are bent alternately on an inner bending line and on an outer bending line, so that two rows of teeth are formed and, between them, grove 39 is formed. Between them, the foot 16 and an optionally provided additional foot 16*a* is held, said latter foot being indicated in dashed lines in FIG. 4. In the same manner, the groove 40 can be formed by two rows of teeth configured as the angled sections 59 (59*a*, 59*b*). In so doing, the teeth may have the same or different widths. Also, they may be arranged alternately inside and outside, or may be arranged in a different sequence.

It is pointed out that at least one of the edges of the metal support plate 21 can be manufactured using the closer ledge 35 of FIG. 6 as an example. In this case, the locating ledge 28 will not need angled sections.

A take-off comb, in particular for a flatbed knitting machine or a loop-forming machine, comprises a number of take-off elements held in a bed 19 that exclusively consists of bent sheet metal parts. The take-off elements 10 may have closing elements 15, which can be shifted by a closer ledge 35. The closer ledge 35 and, optionally, a slider 45 assigned to said ledge, are preferably also bent sheet metal parts. Consequently, the thusly configured take-off comb 7 can be manufactured in a cost-effective and precise manner.

It will be appreciated that the above description of the present invention is susceptible to various modifications, changes and adaptations, and the same are intended to be comprehended within the meaning and range of equivalents of the appended claims.

List of Reference Numbers:

| | |
|---|---|
| 1 | Take-off device |
| 2, 3 | Needle beds |
| 4, 5 | Needles |
| 6 | Comb gap |
| 7 | Take-off comb |
| 8, 9 | take-off rollers |
| 10 | Take-off element |
| 11 | Base body |
| 12 | End |
| 13 | Thread-take-up space |
| 14 | Foot, holding section |
| 15 | Closing element |
| 16 | Foot, holding section |
| 17 | Closing projection |
| 18 | Arrow |
| 19 | Bed |
| 20 | Holding sections |
| 21 | Metal support plate |
| 22 | Girder |
| 23, 24 | Sections |
| 25, 26 | Interstices |
| 27 | Metal alignment plate |
| 28 | Metal positioning plate |
| 29 | Clamping finger |
| 30, 31 | End |
| 32 | Sections |
| 33 | Interstice |
| 34 | Support device |
| 35 | Closer ledge |
| 36 | Interstice |
| 37 | Section |
| 38 | Locating ledge |
| 39 | Groove |
| 40 | Guide groove |
| 41, 42, 43 | Edge |
| 44 | Actuating device |
| 45 | Slider |
| 46, 47 | Edges |
| 48 | Rocker guide |

-continued

| List of Reference Numbers: | |
|---|---|
| 49 | Opening |
| 50 | Bolt |
| 51 | Stiffening edge |
| 52 | Stiffening edge |
| 53 | Sections |
| 54 | Interstices |
| 55, 56, 57 | Edge |
| 58 | End face |
| 59 | Sections |
| 60 | Coupling location, holding section |
| 61 | Metal positioning plate |
| 62 | Bent sheet metal part |
| L | Longitudinal direction |
| I, II | Sections of the opening 49 |
| α | Angle |

The invention claimed is:

1. Take-off comb for a knitting or loop-forming machine, comprising:

several take-off elements having ends set up for holding thread sections and having holding sections, to which the ends are fastened;

closing elements, which are assigned to the take-off elements and have holding sections, to which the closing elements are fastened;

a support device for supporting the take-off elements, which are made of at least one bent sheet metal part or of a flat plastic material part;

a closer ledge for supporting the closing elements, which is made of at least one bent sheet metal part or of a flat plastic material part; and, an actuating device for adjusting the closer ledge relative to the support device.

2. Take-off comb in accordance with claim 1, wherein the support device comprises a girder with angled sections, between which interstices are formed for the accommodation of the take-off elements.

3. Take-off comb in accordance with claim 1, wherein the support device comprises a girder and a metal support plate, which act to support the take-off elements.

4. Take-off comb for a knitting or loop-forming machine, comprising:

several take-off elements having ends set up for holding thread sections and having a shaft to which the ends are fastened; and, a support device, which accommodates the shaft between teeth at longitudinally spaced-apart areas and holds the shaft of the take off element between flat clamping surfaces, and wherein the support device comprises a girder and a metal support plate, which act to support the take-off elements, and the metal support plate has angled sections between which interstices are formed for the accommodation of the take-off elements.

5. Take-off comb in accordance with claim 4, wherein a metal positioning plate is assigned to the girder or to the metal support plate.

6. Take-off comb in accordance with claim 5, wherein the metal positioning plate has angled sections between which the interstices are formed for the accommodation of the take-off elements.

7. Take-off comb in accordance with claim 5, wherein the support device consists exclusively of sheet metal parts or of flat plastic material parts having the configuration of the metal positioning plate, of the metal support plate and of the girder.

8. Take-off comb in accordance with claim 1, wherein, for supporting the closing elements, the closer ledge comprises angled sections and interstices, which are provided for accommodating the holding sections of the closing elements.

9. Take-off comb in accordance with claim 8, wherein the holding sections of the closing elements partially extend over the angled sections of the closer ledge.

10. Take-off comb in accordance with claim 1, wherein a locating ledge is arranged in the closer ledge.

11. Take-off comb in accordance with claim 10, wherein the locating ledge is a bent sheet metal part or as a flat plastic material part.

12. Take-off comb in accordance with claim 10, wherein the locating ledge has an angled edge, which cooperates with the end faces of the closing elements.

13. Take-off comb in accordance with claim 10, wherein the closer ledge and the locating ledge form at least one groove.

14. Take-off comb in accordance with claim 1, wherein the closer ledge is movably supported with respect to the longitudinal direction of the take-off elements.

15. Take-off comb in accordance with claim 1, wherein the actuating device comprises a slider.

16. Take-off comb in accordance with claim 15, wherein the slider is one of a bent sheet metal part, a flat plastic material part, an arrangement consisting of bent sheet metal parts, and an arrangement consisting of flat plastic material parts.

17. Take-off comb in accordance with claim 15, wherein a locating ledge is arranged in the closer ledge, the closer ledge and the locating ledge form at least one groove, and the slider has an angled edge that extends into the groove.

18. Take-off comb in accordance with claim 15, wherein the slider has a groove.

19. Take-off comb in accordance with claim 18, wherein the edge of the closer ledge extends into the groove of the slider.

20. Take-off comb in accordance with claim 15, wherein the slider is movably supported with respect to the longitudinal direction (L) of the closer ledge.

21. Take-off comb in accordance with claim 15, wherein the slider is supported such that it can be moved by a rocker guide at an angle with respect to the take-off elements.

* * * * *